United States Patent [19]

Longthorpe

[11] 4,144,974

[45] Mar. 20, 1979

[54] METHOD OF TEMPORARILY INCREASING THE LOAD CAPACITY OF A POWERED DRUM HOIST

[75] Inventor: Paul L. Longthorpe, Seattle, Wash.

[73] Assignee: Ederer Incorporated, Seattle, Wash.

[21] Appl. No.: 686,129

[22] Filed: May 13, 1976

[51] Int. Cl.[2] ..... B66C 17/00

[52] U.S. Cl. ..... 212/18; 254/188

[58] Field of Search ..... 254/168, 184, 188; 212/11, 15, 18

[56] References Cited

U.S. PATENT DOCUMENTS

| | | | |
|---|---|---|---|
| 1,896,274 | 2/1933 | Ball | 254/168 |
| 2,271,426 | 1/1942 | Harry | 254/188 |
| 2,802,638 | 8/1957 | Ireland | 254/184 |
| 3,321,185 | 5/1967 | Zenke | 254/184 |
| 3,854,592 | 12/1974 | Mordre | 212/11 |
| 3,984,084 | 10/1976 | Boczek | 254/188 |

FOREIGN PATENT DOCUMENTS

| | | | |
|---|---|---|---|
| 1266468 | 4/1968 | Fed. Rep. of Germany | 254/188 |

*Primary Examiner*—Albert J. Makay
*Assistant Examiner*—Carl Rowold
*Attorney, Agent, or Firm*—Seed, Berry, Vernon & Baynham

[57] ABSTRACT

A convertible crane is provided with a main trolley which carries a powered hoist along a horizontal path. A trailer trolley also carries a hoist which is powered from the main trolley. Each of the hoists thus have a powered drum which will increase the total line capacity of the crane allowing the crane to be used for temporary longer load travel or higher capacity lifting depending upon the amount of reeving or parts of line used to support the load from the trolleys.

4 Claims, 5 Drawing Figures

METHOD OF TEMPORARILY INCREASING THE LOAD CAPACITY OF A POWERED DRUM HOIST

BACKGROUND OF THE INVENTION

1. Field of the Invention

This invention relates to cranes of the type in which a movable support or trolley carries a hoist on a girder. More particularly, the invention relates to methods and apparatus for temporarily increasing the lifting capacity or lifting travel of such a crane by adding a secondary trolley having a hoist but utilizing the power supply from the main trolley and after such temporary use, converting the crane back to its lower capacity or lower lift travel by removing the secondary trolley and its hoist.

2. Description of the Prior Art

A common problem in the construction of hydroelectric dams, nuclear reactors, and other construction projects which ultimately require a long-lasting crane is that the powered movable hoist on the crane is desirably designed for a useful life of fifty to one-hundred years and at a load capacity or lift travel substantially less than what is desired during temporary phases of its use, such as for initial construction. For example, in a nuclear reactor, a typical load capacity for initial construction, may be four-hundred tons whereas the subsequent capacity for ordinary long-term use of the crane may be a small as two hundred tons or less.

The conventional solution to this problem has been to over design a single powered hoist for the short period of initial construction. This is extremely expensive and wasteful. Another solution has been to provide a second identical powered hoist on a secondary movable support. This is also very expensive since the additional movable powered hoist, with its expensive motor, drive mechanisms and controls, is costly and may have no further use to the customer after construction and may not be readily sold to another user.

One unique solution to providing an inexpensive temporary increase in the capacity, either initially or during some period in the useful life of the crane, is described in U.S. Pat. No. 3,854,592. In this patent, a crane load capacity is increased inexpensively by adding an unpowered trailer trolley to the crane and carrying a plurality of sheaves on the trailer trolley such that the number of parts of line and thus the capacity of the crane can be increased by spreading the load along the length of the crane but yet not require adding the more expensive power to the trailer trolley so that it remains in effect a "trailer" rather than an independent separately powered second hoist. This solution has proven very advantageous in reducing the expense of providing for temporary increases in capacity but lacks the versatility in providing increased travel lift of the load or increased capacity of the crane since the drum of the powered hoist on the main trolley is limited in line capacity. As a result, the amount of reeving that can be added between the main and trailer trolleys is limited, thus limiting the total capacity of the crane or if the larger capacity can be met by the added reeving, the length of the lift travel is limited.

SUMMARY OF THE INVENTION

It is an object of this invention to provide an apparatus for temporarily increasing the lift or the load capacity of a crane.

It is another object of the invention to provide a method for temporarily increasing the lift or load capacity of a crane carried movable powered hoist without increasing the power supply on the hoist.

Basically, the apparatus objects are obtained by combining, on a crane, a powered movable main support which carries a powered hoist, including a main or primary drum, which is designed for long-life, low-capacity or short-lift operation. A movable secondary support is coupled to the main support with the secondary support also carrying a hoist including a secondary or auxiliary drum. The secondary drum is powered from the power supply carried on the main support.

In the preferred embodiment, the drive train for the secondary drum from the main hoist is through gears and the secondary support is coupled to the main support as a trailer by a link pivotally connected to the two drums at their axes of rotation. This enables the crane beam or girder to deflect under increased temporary loads without affecting the distance between the axes of the drums and thus, will not effect the drive transmission connecting the two drums. Alternatively, a chain and sprocket drive may be used. As another alternative, the supports need not be connected at the axes of rotation of the drums but could be connected as shown in U.S. Pat. No. 3,854,592 and other forms of hydraulic or pneumatic drive means employed. In all cases, however, the advantages of the invention are best obtained by utilizing the same motive or power source of the main support as the source of power for the drive of the secondary drum and secondary support.

Conventionally, the main drum is provided with left-hand and right-hand grooving so that a single line may be wrapped with both ends simultaneously on the drum during normal long-time use. In the conversion of this invention, the main drum is either replaced with a temporary drum, having grooving all running in one direction, or as in the preferred embodiment, a sleeve is temporarily added into the main drum to convert one-half of the grooves to the same direction as the grooves on the other half of the drum.

The method of temporarily increasing the travel or lift capacity of a crane from a long-life, low-capacity or length of travel comprises driving a movable main support along a horizontal path, moving a movable, secondary support along the path in response to movement of the main support, reeving a line on a main drum on said main support, driving said main drum from a power source having a predetermined low output, reeving the line on a secondary drum carried on said secondary support, powering said secondary drum from said power source on said main support, temporarily lifting a load with said line and finally removing the secondary support and its drum and reeving both ends of the line onto the drum of said main support whereby the load is then lifted at the lower capacity travel without changing the power source.

It should be understood that both in the apparatus and method, the advantages of this inventions can be realized either by doubling the amount of reeving and thus parts of line to double the capacity of the powered hoists with a hook speed under construction load or other higher capacity load at one-half the basic speed of the main powered hoist when used for long time conventional use. Since the parts of line have been doubled, however, the capacity can be doubled without increasing the horsepower of the motor driving the main drum. If the reeving is not doubled, the doubling of the line storage capacity by adding the second drum will allow the speed to be maintained unchanged but will provide a doubling of the lift travel of the hook. As is apparent, any combination of travel increase or load capacity increase can be obtained without changing the basic horsepower requirement of the long life main hoist merely by making some combination of reeving less than a doubling of the reeving. That is, an increase in one-third of the number of parts of line by providing suitable reeving will increase the load capacity by one-third but will also improve the travel by two-thirds.

Utilizing the principles of the invention, it is estimated that for a typical installation, the cost of adding a trailer support with an auxiliary or secondary drum driven from the main or primary drum power source would cost about twelve to fifteen thousand dollars. Compared to this if an independent second powered movable support were added with an independent second drive package as is conventionally done, the cost would be about twenty thousand to eighty thousand dollars depending on the amount of controls and the size of the machinery on the second drive package. As is thus apparent, a very substantial savings in cost is realized by utilizing the principles of this invention.

DETAILED DESCRIPTION OF THE PREFERRED EMBODIMENTS

Figure 1:
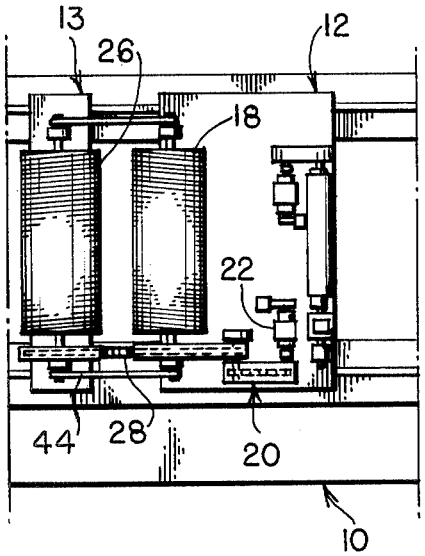
FIG. 1 is a fragmentary plan view of a crane embodying the principles of the invention.
Figure 2:
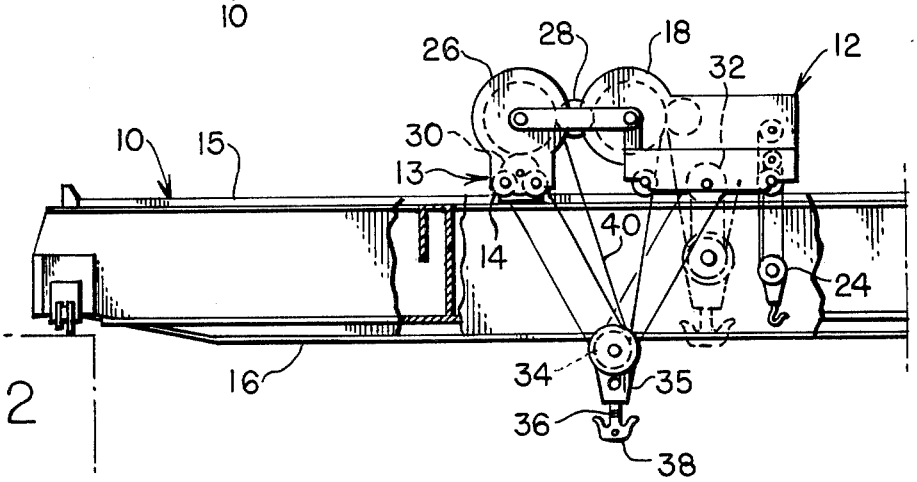
FIG. 2 is a side elevation of the crane shown in FIG. 1.

FIGS. 1 and 2 illustrate a crane 10 having main or primary movable support 12 and an auxiliary movable support 13. Each of the supports are carried by wheels 14 which run on a track 15. The track is on a beam or girder 16 that spans an opening in which the reactor or other equipment is to be placed.

As best shown in FIG. 2 the main support is provided with a conventional drum 18 that is powered by a suitable drive 20 in this embodiment illustrated a chain and sprocket drive. A motor 22 is the power source for the drive 20 and is of a horsepower designed for the long life, lower capacity needs of the crane. A small, supplemental hoist 24 may be provided if desired but forms no part of the invention.

Figure 3:
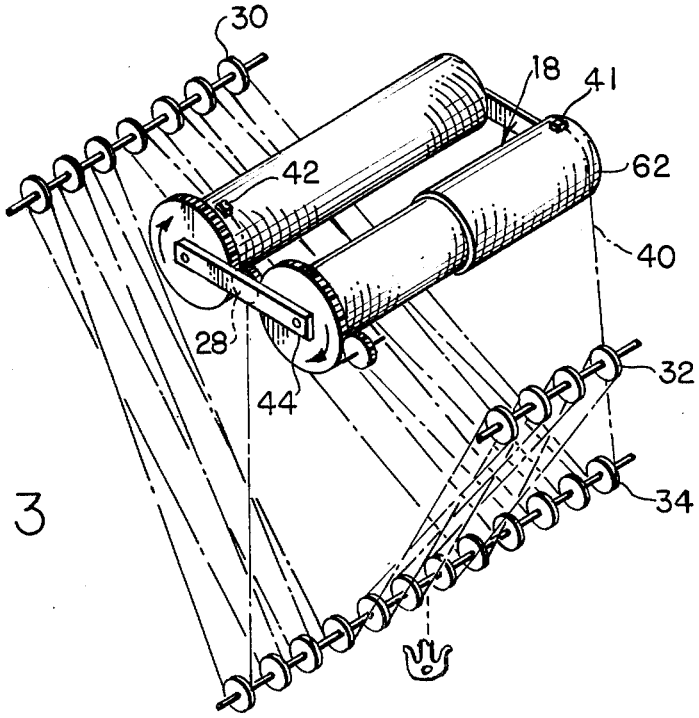
FIG. 3 is a schematic isometric illustrating one suitable reeving using the secondary hoist of the subject invention and showing the reeving where the load capacity of the crane is doubled by doubling the reeving over that of the long life sole main support configuration of FIG. 5 and with the load in the line to each drum being equal to the load at the hook divided by the number of parts of line or equal to the sum of the load on the two lines to the drum as shown in FIG. 5.

The auxiliary support 13 also includes a drum 26. It is an important aspect of this invention that the drum 26 is driven by a drive transmission 28 that is powered directly or indirectly from the motor or power source 22 located on the main support 12. In the embodiment illustrated in FIGS. 2 and 3, the auxiliary hoist is provided with sheaves 30 and the main hoist is provided with sheaves 32 to increase the number of parts of line supporting the load.

The load is supported by a plurality of sheaves 34 that are mounted in a hook bracket 35. A bearing 36 connects the hook bracket to a hook 38. The bearing provides for rotational alignment of the load since winding of the line off or onto the two drums will cause the line to move toward or away from each symmetrically about the load. Thus, the load will not shift laterally during lowering or raising but will be twisted a slight degree as the lines move toward or away from each other. This twist can be eliminated at the load itself by causing the load to swivel on the bearing 36. In the embodiment illustrated in FIG. 3, the line 40 starts at one end 41 on the main drum and has its other end secured as at 42 to the opposite end of the auxiliary drum. As is well known, the line then passes over the sheaves 34 and around the sheaves 32 and 40 to distribute the weight of the load on the main and auxiliary trolleys.

Since the embodiment illustrated in FIGS. 1–4 has a gear drive (or an equivalent sprocket-chain drive) interconnecting the two drums, it is necessary that the distance between the axes or rotation of the sprockets or gears not change during loading of the crane. For example, if the load is very great, the crane will tend to be deflected downwardly at a point between the main and auxiliary supports. To prevent changing the distance between the gears or sprockets in the interconnecting drive transmission, the two supports are joined by a link or links 44 that is pivotally connected to the drums at their axes of rotation. The link thus provides the function of a coupling so that the trailer will move along with the main support when being positioned over the load and also assures that no change in spacing occurs between the two drums. It should be understood that if other forms of drive transmissions are used such as the hydraulic drives of FIG. 4, the coupling between the two supports can be of a different type such as that shown in U.S. Pat. No. 3,854,592.

Figure 4:
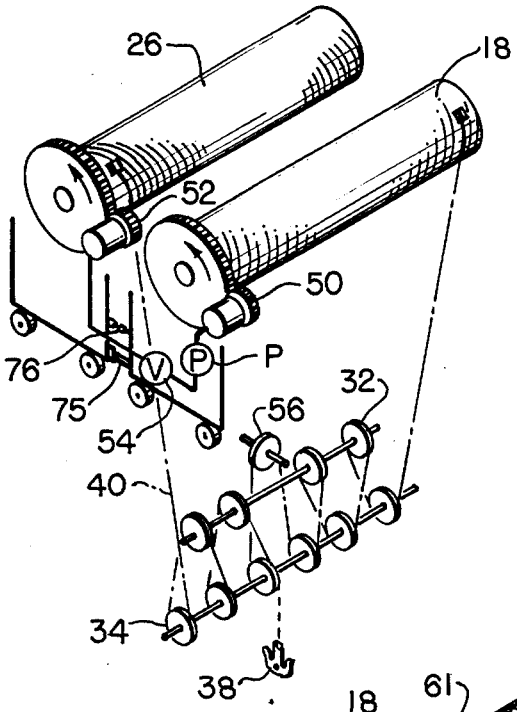
FIG. 4 is a schematic illustration showing a single line going to the load with the lift travel of the load being doubled by the increase in line storage capacity of the auxiliary drum. In this embodiment there is also illustrated the simultaneous powering of the main and auxiliary drums by using fluid motors powered from a common pump on the main movable support.

FIG. 4 illustrates another extreme application of the invention. In FIG. 4 the main drum 18 and auxiliary drum 26 are provided on the supports shown in FIGS. 1 and 2 and the line 40 is joined to the drums as is the embodiment in FIG. 3 but without reeving 30. In this embodiment, each of the drums is powered in a conventional manner by hydraulic motors 50 and 52 powered by a common hydraulic pump P located on the main support. The hydraulic pump can be isolated from the auxiliary motor 52 by a valve 54 such that removal of the auxiliary movable support will allow isolation of the motor 50 and pump 52 for a long time use. In this embodiment the invention is operated in the same manner with the difference between this embodiment and that shown in FIGS. 1–3 being in that the additional storage capacity on the auxiliary drum allows the hook to travel twice its normal distance as where one drum was used in FIG. 5.

Figure 5:
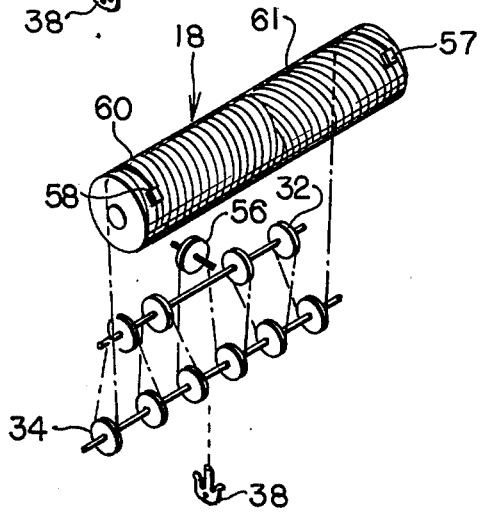
FIG. 5 illustrates a typical reeving configuration for the movable main support and hoist with the auxiliary hoist removed as when the crane is used for its normal long-life, low-capacity use.

FIG. 5 illustrates a typical drum 18 forming part of the hoist 12 but showing the drum reeved for its long time conventional use. In this configuration, the line has been removed from the auxiliary support and drum and that structure has been removed from the crane. The line 40 thus terminates at opposite ends 57 and 58 giving a double line connection to the drum. As is common in this type of reeving, a direction changing sheave 56 is also rotatably mounted on the movable support 12 and the hook 38 is coupled to the sheeves 34.

An important feature of the invention is best illustrated in FIG. 5. In this drum 18 which is shown in its condition for long time use, it can be noted that the drum is provided with right-hand and left-hand grooves 60 and 61, respectively. These opposite directional grooves assure that the line will wind on the drum simultaneously and symmetrically along the axis of the drum so that the load is maintained substantially centrally beneath the crane. When converting this drum for use in the embodiments of FIGS. 1–4 wherein an auxiliary drum is added, the entire grooving of the main drum is advantageously converted to the same direction so that the line can wrap smoothly from one end of the drum to the other. Correspondingly, the auxiliary drum is provided with grooving in the opposite direction so that its end of the line can travel smoothly along the length of the auxiliary drum. There are two ways to accomplish the conversion of the main drum from its normal double directional grooving to a single directional grooving. The preferred technique is to employ a sleeve 62 of a type that is welded or bolted over the grooving. The sleeve has the same grooving as the opposite end of the drum so that when in place, the grooving is all in one direction on the main drum. In the alternative for the temporary construction phase or high-lift phase, the main drum can be replaced by another main drum having grooving all in the same direction as in FIG. 4. The sleeve approach is preferred since it is less expensive and the technology for securing sleeves to the drum for restoring worn grooves in the same direction is known in the prior art.

To increase the versatility with the construction or other high-capacity reeving, an adjustable voltage DC type control with a conventional 250% speed capacity may be provided. Using this existing control circuitry, a no load hook speed that is 250% of the full load hook speed can be employed.

Another alternative is to use multiple idler gears in the transmission drive between the two drums to increase the spacing between the trailer and main supports any desired distance apart to reduce the point loading on the beam and thus increase its capacity. Also, the auxiliary drum can be driven at a speed which is greater than that of the normal rotational speed of the main drum. This can be accomplished merely by changing the drive ratios in the drive transmission between the two drums. Increasing the auxiliary drum diameter or length can accommodate the additional line.

Other modifications and advantages will be apparent to one skilled in the art without departing from the principles described herein. Accordingly, the invention is not to be limited to the specific embodiments illustrated in the drawing.

The embodiments of the invention in which a particular property or privilege is claimed are defined as follows:

1. A method of temporarily increasing the load capacity of powered drum hoist which is movable along a horizontal rail, while maintaining the magnitude of lifting travel substantially constant, said method comprising:

mounting a first hoist support on said rail through a pair of spaced apart, rotatably mounted support wheels, said first hoist further including means for selectively urging said first hoist support along said rail in a horizontal direction;

mounting a first cable drum in said first hoist support;

coupling a rotating power unit to said first cable drum for selectively rotating said drum, said power unit being carried by said first hoist support;

mounting a second hoist support on said rail through a pair of rotatably mounted support wheels, said first hoist support being freestanding and separately operable from said second hoist support;

rotatably mounting a second cable drum in said second hoist support, said second cable drum being powered solely by the power unit of said first hoist support, connecting a removable link between said first and second hoist supports such that said second hoist support moves along said rail with said first hoist support;

suspending a set of traveling sheaves from said first and second drums, said traveling sheaves being rotatably mounted in a load supporting bracket;

securing a first load to said load supporting bracket and selectively raising and lowering said first load by selectively rotating said first and second drums, the weight of said first load being greater than the lifting capacity of said first drum alone;

removing said first load from said load supporting bracket;

detaching said second hoist support from said first hoist support by removing said removable link from said first and second hoist supports;

removing said second hoist support;

suspending the traveling sheaves of said load supporting bracket from said first drum; and securing a second load to said load supporting bracket, and selectively raising and lowering said second load by selectively rotating said first drum, the weight of said second load being substantially less than the weight of said first load and within the lifting capacity of said first drum alone, and the magnitude of lifting travel for said second load being substantially equal to the magnitude of lifting travel for said first load.

2. The method of claim 1, further including the step of suspending said traveling sheaves from a set of first and second upper sheaves mounted on said first and second hoist supports, respectively.

3. The method of claim 1, wherein said step of connecting said removable link includes connecting the link to said first and second hoist supports at the rotational axes of said first and second cable drums such that downward deflection of said rail by the weight of the load will not affect the distance between the axes of rotation of the first and second drums.

4. The method of claim 1, wherein said first drum has both left-hand direction and right-hand direction line grooves on opposite ends of the first drum when said first and second hoist supports are connected to each other through said removable link, and including the step of changing the grooving direction of one end of the first drum to provide all one direction along the total length of the drum when said second hoist support is detached from said first hoist support so that a line on the drum starts at one end and wraps toward the other along the entire length of the drum.

* * * * *